US010408385B2

(12) United States Patent
Setaka

(10) Patent No.: US 10,408,385 B2
(45) Date of Patent: Sep. 10, 2019

(54) METHOD OF DISCHARGING RESIDUAL LIQUID IN LIQUEFIED GAS TANK

(71) Applicant: IHI Corporation, Tokyo (JP)

(72) Inventor: Hirotomo Setaka, Tokyo (JP)

(73) Assignee: IHI CORPORATION, Tokyo (JP)

( * ) Notice: Subject to any disclaimer, the term of this patent is extended or adjusted under 35 U.S.C. 154(b) by 127 days.

(21) Appl. No.: 15/291,841

(22) Filed: Oct. 12, 2016

(65) Prior Publication Data

US 2017/0030525 A1 Feb. 2, 2017

Related U.S. Application Data

(63) Continuation of application No. PCT/JP2015/061092, filed on Apr. 9, 2015.

(30) Foreign Application Priority Data

Apr. 15, 2014 (JP) ..... 2014-083246

(51) Int. Cl.
*F17C 9/02* (2006.01)
*F17C 9/00* (2006.01)
*F17C 13/00* (2006.01)

(52) U.S. Cl.
CPC ..... *F17C 9/02* (2013.01); *F17C 9/00* (2013.01); *F17C 13/004* (2013.01); (Continued)

(58) Field of Classification Search
CPC .... F17C 9/00; F17C 9/02; F17C 13/03; F17C 13/004; F17C 2227/04; F17C 2227/0302
See application file for complete search history.

(56) References Cited

U.S. PATENT DOCUMENTS 3,205,665 A * 9/1965 Van Horn ..... B65G 5/00 405/56
3,867,818 A 2/1975 Tornay
(Continued)

FOREIGN PATENT DOCUMENTS

JP 48-63314 A 9/1973
JP 8-261396 A 10/1996
(Continued)

OTHER PUBLICATIONS

International Search Report dated Jun. 30, 2015 in PCT/JP2015/061092 (2 pages).

*Primary Examiner* — Brian M King
(74) *Attorney, Agent, or Firm* — Rothwell, Figg, Ernst & Manbeck, P.C.

(57) ABSTRACT

Water is injected into a top of a liquefied gas tank (water injection step); residual stored liquid in the tank is vaporized by heats of water injected in the water injection step so that the vaporized gas discharges from the top of the tank (residual liquid vaporization/discharge step); even after all of the stored liquid is vaporized in the residual liquid vaporization/discharge step, the injection of the water into the tank is continued to melt ice solidified through cold heat appropriation of the stored liquid in the residual liquid vaporization/discharge step and return the temperature in the tank to normal temperature (hot-up step); and attained is water discharge from a bottom of the tank having the temperature in the tank returned to normal temperature in the hot-up step while inert gas is supplied into the tank (water discharge step).

3 Claims, 2 Drawing Sheets

(52) U.S. Cl.
CPC .. *F17C 2201/052* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2227/0302* (2013.01); *F17C 2227/0316* (2013.01); *F17C 2227/04* (2013.01); *F17C 2227/044* (2013.01); *F17C 2260/015* (2013.01); *F17C 2260/048* (2013.01)

(56) References Cited

U.S. PATENT DOCUMENTS 4,649,019 A * 3/1987 Jawor ..... F22B 37/00
376/316
5,678,411 A * 10/1997 Matsumura et al. ..... F17C 9/02
62/50.3

FOREIGN PATENT DOCUMENTS

| | | | | | |
|---|---|---|---|---|---|
| JP | S529003 | A | * | 1/1997 | ..... F17C 9/00 |
| JP | 10-30795 | A | | 2/1998 | |
| JP | 10-160098 | A | | 6/1998 | |
| JP | 2000-161593 | A | | 6/2000 | |
| JP | 2007-24300 | A | | 2/2007 | |
| JP | 2011-236929 | A | | 11/2011 | |

* cited by examiner

METHOD OF DISCHARGING RESIDUAL LIQUID IN LIQUEFIED GAS TANK

CROSS-REFERENCE TO RELATED APPLICATIONS

This application is a Continuation Application based on International Application No. PCT/JP2015/061092, filed Apr. 9, 2015, which claims priority on Japanese Patent Application No. 2014-083246, filed Apr. 15, 2014, the entire contents of which are incorporated herein by reference.

TECHNICAL FIELD

The present disclosure relates to a method of discharging residual liquid in a liquefied gas tank.

BACKGROUND ART

Generally in a liquefied gas tank for storage of liquefied gas such as liquefied natural gas (LNG) or liquefied petroleum gas (LPG), open inspection is sometime conducted to check influences due to aged deterioration.

Such open inspection is conducted by a worker or workers who enter into the liquefied gas tank. Thus, before the open inspection, preliminary works are used to completely discharge liquefied gas as content in the liquefied gas tank and replace residual gas in the tank with air to allow the workers to enter into the tank.

Commonly, upon opening the liquefied gas tank, residual stored liquid in the tank is reduced as much as possible into minimization; the stored liquid in the tank is vaporized by use of heat input from ambient air; and heating is further conducted to discharge the vaporized gas from the tank. Such residual liquid discharge method is called as natural heat input type.

For example, Patent Literatures 1 and 2 show general state of art pertinent to a method of discharging residual liquid in a liquefied gas tank.

CITATION LIST

Patent Literatures

Patent Literature 1: JP 10-160098A
Patent Literature 2: JP 2007-24300A

SUMMARY

However, in the common methods of discharging residual liquid in a liquefied gas tank which rely on natural heat input, considerable time is spent for discharging all of the liquefied gas. And thus the liquefied gas tank may be stopped for a long period of time, including time spent for succeeding replacement with inert gas and air and time spent for open inspection itself. This may result in deteriorated running efficiency of the liquefied gas tank.

In the method disclosed in Patent Literature 1, a great deal of nitrogen gas is used to heat the liquefied gas. In the method disclosed in Patent Literature 2, water is used as pressurizing medium in a residual gas expelling step so that a pump for injecting water under pressure may be specially prepared.

The disclosure was made in view of the above-mentioned common problems and has its object to provide a method of discharging residual liquid in a liquefied gas tank which can efficiently conduct a discharge operation of residual liquefied gas in the tank in a short period of time without use of a special device and can substantially shorten an outage period of the tank for open inspection.

The disclosure is directed to a method of discharging residual liquid in a liquefied gas tank comprising:

injecting liquid into the liquefied gas tank; and vaporizing residual stored liquid in the liquefied gas tank into vaporized gas by heats of the injected liquid so that the vaporized gas discharges from the liquefied gas tank.

It is preferable in the method of discharging residual liquid in the liquefied gas tank that the injected liquid is water, and conducted are a water injection step of injecting the water into the liquefied gas tank through a top thereof, a residual liquid vaporization/discharge step of vaporizing residual stored liquid in the liquefied gas tank into the vaporized gas by heats of the water injected in the water injection step so that the vaporized gas discharges from the liquefied gas tank through the top thereof, a hot-up step of continuing the injection of the water into the liquefied gas tank after all of the stored liquid is vaporized in the residual liquid vaporization/discharge step to melt ice solidified through cold heat appropriation of the stored liquid in the residual liquid vaporization/discharge step and return a temperature in the liquefied gas tank to normal temperature and a water discharge step of discharge of the water from the liquefied gas tank through a bottom thereof, the tank having the temperature therein returned to the normal temperature, while inert gas is supplied into the liquefied gas tank through the top thereof.

Further, it is preferable that, in the residual liquid vaporization/discharge step, the vaporized gas discharging from the liquefied gas tank through the top thereof is burned in a flare stack.

A method of discharging residual liquid in a liquefied gas tank according to the disclosure can have excellent effects that discharge of residual liquefied gas in the liquefied gas tank can be efficiently attained in a short period of time without use of a special device and that an outage period of the liquefied gas tank for open inspection can be substantially shortened.

DESCRIPTION OF EMBODIMENT

Next, an embodiment of the disclosure will be described in conjunction with attached drawings.

Figure 1:
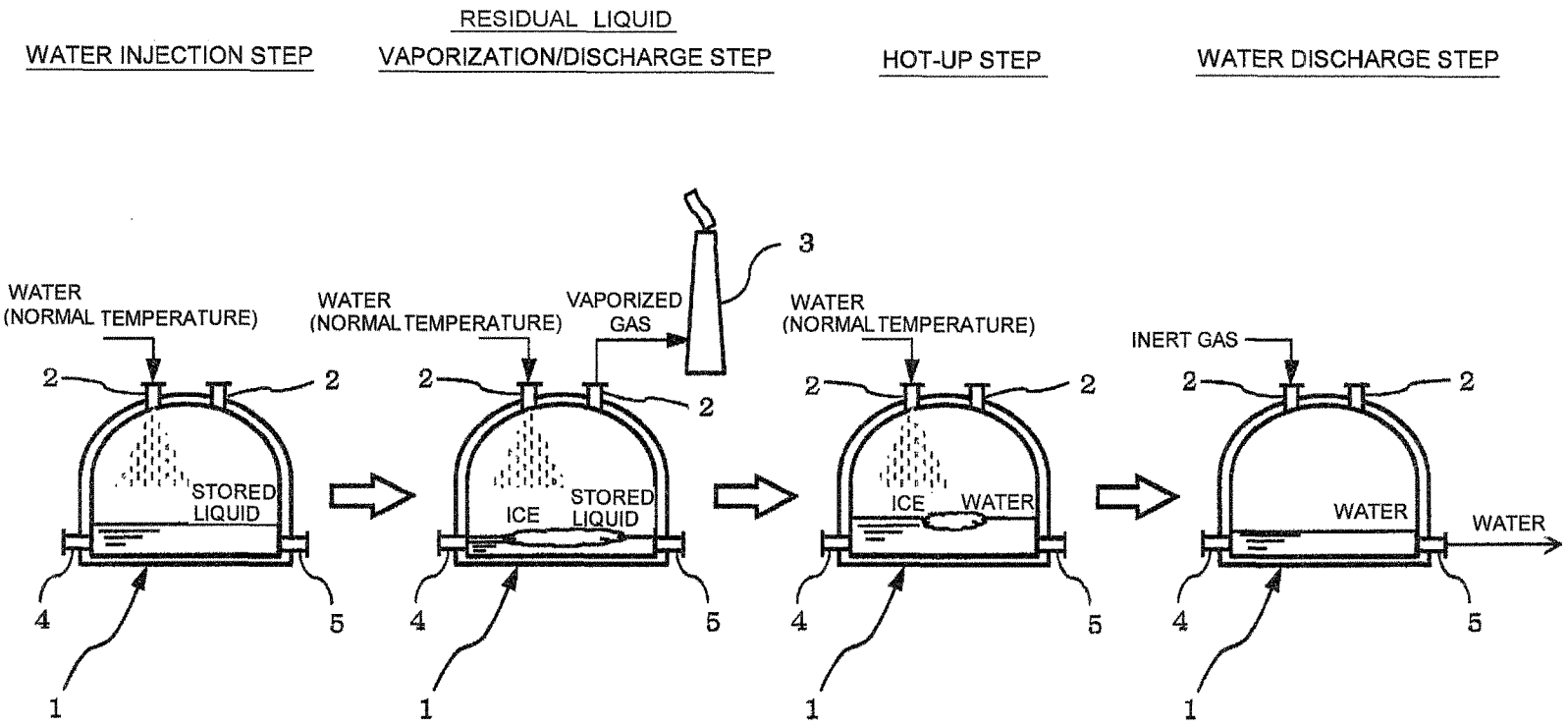
FIG. 1 is a schematic stepchart for showing an embodiment for a method of discharging residual liquid in a liquefied gas tank according to the disclosure.
Figure 2:
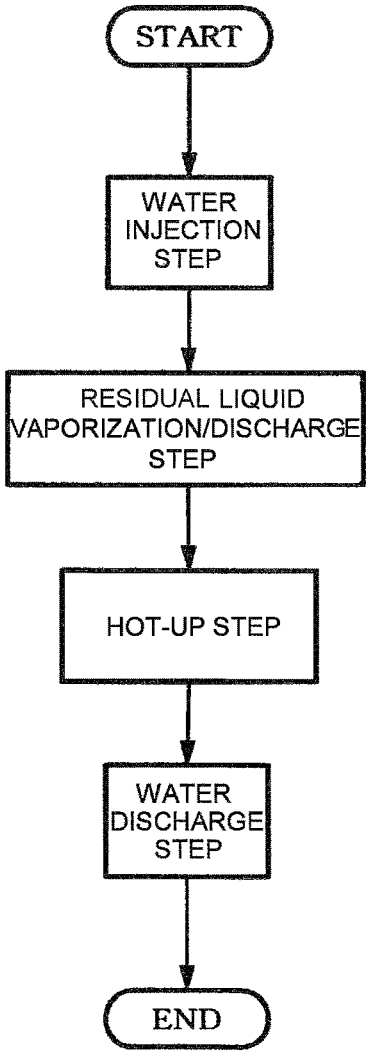
FIG. 2 is a flowchart for showing the embodiment of the method of discharging the residual liquid in the liquefied gas tank according to the disclosure.

FIGS. 1 and 2 show the embodiment of a method of discharging residual liquid in a liquefied gas tank according to the disclosure. The embodiment resides in that liquid is injected into a liquefied gas tank 1 and residual liquid in the liquefied gas tank 1 is vaporized into vaporized gas by heats of the injected liquid so that the vaporized gas discharges from the liquefied gas tank 1.

In the embodiment, the injected liquid is water, and conducted are a water injection step, a residual liquid vaporization/discharge step, a hot-up step and a water discharge step.

In the water injection step, water with normal temperature is injected into the liquefied gas tank 1 through a top thereof. The liquefied gas tank 1 is normally provided at the top thereof with nozzles 2 such as a nozzle for connection with a safety valve and various spare nozzles. Thus water injection is conducted with any nozzle 2.

In the residual liquid vaporization/discharge step, residual stored liquid in the liquefied gas tank 1 is vaporized into vaporized gas by heats of the injected water in the water injection step so that the vaporized gas discharges from the liquefied gas tank 1 through the top thereof. This discharge is conducted with the nozzle 2. In the residual liquid vaporization/discharge step, the vaporized gas discharging from the liquefied gas tank 1 through the top thereof is burned in a flare stack 3.

In the hot-up step, the injection of the water into the liquefied gas tank 1 is continued even after all of the stored liquid is vaporized in the residual liquid vaporization/discharge step to melt ice solidified through cold heat appropriation of the stored liquid in the residual liquid vaporization/discharge step and return a temperature in the liquefied gas tank 1 to normal temperature.

In the water discharge step, discharge of the water from the liquefied gas tank 1 through a bottom thereof is attained with the temperature in the tank being returned to normal temperature in the hot-up step while nitrogen or other inert gas is supplied to the liquefied gas tank 1 through the top thereof. Usually the bottom of the liquefied gas tank 1 has a side surface provided with a feed nozzle 4 for feeding of the liquid to be stored into the liquefied gas tank 1 and a discharge nozzle 5 for discharge of the stored liquid from the tank 1; the discharge nozzle 5 is utilized for the discharge of the water.

Next, mode of operation of the above-mentioned embodiment will be described.

For opening the liquefied gas tank 1, stored liquid is extracted through the discharge nozzle 5 as much as possible so that residual stored liquid becomes minimum.

In this state, firstly water with normal temperature is injected into the liquefied gas tank 1 through the nozzle 2 on the top thereof (water injection step).

By heats (sensible and latent heats) of the water injected in the water injection step, residual stored liquid in the liquefied gas tank 1 is vaporized into vaporized gas so that the vaporized gas discharges through the nozzle 2 on the top of the liquefied gas tank 1 (residual liquid vaporization/discharge step). In the residual liquid vaporization/discharge step, the vaporized gas discharging from the liquefied gas tank 1 through the top thereof is burned in the flare stack 3.

Even after all of the stored liquid is vaporized in the residual liquid vaporization/discharge step, the injection of the water into the liquefied gas tank 1 is continued to gradually melt ice solidified through cold heat appropriation of the stored liquid in the residual liquid vaporization/discharge step and return the temperature in the liquefied gas tank 1 to normal temperature (hot-up step). The temperature in the liquefied gas tank 1 is measured by a temperature sensor (not shown) and, when the temperature in the liquefied gas tank 1 measured by the temperature sensor becomes higher than 0° C., then it can be judged that ice is melted into water.

When the temperature in the tank is returned to normal temperature in the hot-up step, discharge of the water is attained through the discharge nozzle 5 on the side surface of the bottom of the liquefied gas tank 1 while nitrogen or other inert gas is supplied into the liquefied gas tank 1 through the nozzle 2 on the top thereof (water discharge step). The inert gas may prevent an interior of the liquefied gas tank 1 from becoming vacuum and prevents the vaporized gas from being burned in the tank 1 even if any vaporized gas from the stored liquid remains in the tank 1.

As a result, time spent for discharge of all of the liquefied gas in the embodiment can be drastically shortened in comparison with that in the common methods of discharging residual liquid in the liquefied gas tank relying on natural heat input. Including time spent for succeeding replacement with inert gas and air and time spent for open inspection itself, an outage period of the liquefied gas tank 1 can be shortened. As a result, the liquefied gas tank 1 can be improved in running efficiency. For instance, in a case where an amount of residual liquid is 800 kl, about 150 days (5 months) or so are spent for residual liquid treatment and hot-up in the common methods of discharging residual liquid in the liquefied gas tank relying on natural heat input whereas that in the embodiment can be shorted into about 10-20 days or so.

For heating of the liquefied gas, the embodiment requires only injection of water with normal temperature and does not use a great deal of nitrogen gas unlike the method as disclosed in Patent Literature 1. Unlike the method disclosed in Patent Literature 2 where water is used as pressurizing medium in a residual gas expelling step, the embodiment utilizes water as heat medium solely for forced vaporization of the stored liquid and thus uses no special pump for injecting water under pressure.

Thus, the discharge of the residual liquefied gas in the liquefied gas tank 1 can be attained effectively in a short period of time without using any special device and an outage period of the liquefied gas tank 1 for open inspection can be substantially shortened.

The injected liquid is water, and conducted are the water injection step, the residual liquid vaporization/discharge step, the hot-up step and the water discharge step. In the water injection step, the water can be injected, using the usual nozzle 2 such as that for connection with a safety valve or various spare nozzles arranged on the top of the liquefied gas tank 1. In the residual liquid vaporization/discharge step, the nozzle 2 is also utilized for discharge of vaporized gas. In the hot-up step, water injection can be conducted with the nozzle 2 just like the water injection step. In the water discharge step, the water discharge can be attained, using the usual discharge nozzle 5 arranged on the side surface of the bottom of the liquefied gas tank 1. Thus, discharge of the liquefied gas can be attained with no modification of an existing liquefied gas tank 1 and no additional arrangement of a special device.

Further, in the residual liquid vaporization/discharge step, the vaporized gas discharging from the liquefied gas tank 1 through the top thereof is burned in the flare stack 3 so that vaporized gas treatment is reliably conducted with no fear of fire disaster due to ignition to the vaporized gas.

It is to be understood that a method of discharging residual liquid in a liquefied gas tank according to the disclosure is not limited to the above embodiment and that various changes and modifications may be made without departing from the scope of the disclosure.

REFERENCE SIGNS LIST

1 liquefied gas tank
2 nozzle
3 flare stack
5 discharge nozzle

The invention claimed is:

1. A method of discharging residual liquid in a liquefied gas tank, comprising:

injecting liquid into the liquefied gas tank; and vaporizing residual stored liquid in the liquefied gas tank into vaporized gas by heat transferred from the injected liquid so that the vaporized gas discharges from the liquefied gas tank, wherein the injected liquid is water, and the steps of injecting liquid and vaporizing residual stored liquid further include:

a water injection step of injecting the water into the liquefied gas tank through a first existing nozzle on a top of the liquefied gas tank, a residual liquid vaporization/discharge step of vaporizing residual stored liquid in the liquefied gas tank into the vaporized gas by heat transferred from the water injected in the water injection step so that the vaporized gas discharges from the liquefied gas tank through a second existing nozzle on the top of the liquefied gas tank, a hot-up step of continuing the injection of the water into the liquefied gas tank after all of the stored liquid is vaporized in the residual liquid vaporization/discharge step to melt ice solidified through cold heat appropriation of the stored liquid in the residual liquid vaporization/discharge step, and wherein the hot-up step continues until after a temperature inside the tank is greater than 0° C., and a water discharge step of discharging the water from the liquefied gas tank after the hot-up step, wherein the water discharge step includes discharging the water through a bottom of the liquefied gas tank, while inert gas is supplied into the liquefied gas tank through the first existing nozzle on the top of the liquefied gas tank.

2. The method of discharging residual liquid in the liquefied gas tank as claimed in claim 1, wherein during the residual liquid vaporization/discharge step, the vaporized gas discharging from the liquefied gas tank through the top of the liquefied gas tank is burned in a flare stack.

3. The method of claim 1, wherein in the residual liquid vaporization/discharge step, the residual stored liquid is heated into the vaporized gas using only the heat transferred from the water injected in the water injection step.

* * * * *